US006176645B1

(12) United States Patent
Semeia

(10) Patent No.: US 6,176,645 B1
(45) Date of Patent: Jan. 23, 2001

(54) HYDROSTATIC BALANCING JACKET FOR UNDERWATER DIVING

(75) Inventor: Roberto Semeia, San Salvatore Di Cogorno (IT)

(73) Assignee: Scubapro Europe S.r.l. (IT)

( * ) Notice: Under 35 U.S.C. 154(b), the term of this patent shall be extended for 0 days.

(21) Appl. No.: 09/253,143

(22) Filed: Feb. 19, 1999

(51) Int. Cl.[7] ..... B63C 11/02
(52) U.S. Cl. ..... 405/186; 2/312; 224/627
(58) Field of Search ..... 405/186; 224/600, 224/627, 625; 2/102, 312

(56) References Cited

U.S. PATENT DOCUMENTS

| | | | | |
|---|---|---|---|---|
| 1,147,225 | * | 7/1915 | Feldman | 2/312 X |
| 2,120,420 | * | 6/1938 | Topper | 405/186 |
| 2,134,473 | * | 10/1938 | Engelson | 2/102 |
| 4,551,107 | | 11/1985 | Scheurer et al. . | |
| 4,990,115 | | 2/1991 | Vorhauer et al. . | |
| 5,378,084 | * | 1/1995 | Waters et al. | 405/186 |
| 5,803,667 | * | 9/1998 | Seligman | 405/186 |
| 5,915,535 | * | 6/1999 | Henrekin-Jordan | 2/312 X |
| 5,953,750 | * | 9/1999 | Stella | 405/186 X |

FOREIGN PATENT DOCUMENTS 0693 421 A1 1/1996 (EP) .

* cited by examiner

*Primary Examiner*—Eileen D. Lillis
*Assistant Examiner*—Tara L. Mayo
(74) *Attorney, Agent, or Firm*—Larson & Taylor, PLC

(57) ABSTRACT

Hydrostatic balancing jacket for underwater diving, including a dorsal element from which there proceed two shoulder flaps and two abdominal/pectoral flaps, each shoulder flap being connectable to the corresponding abdominal/pectoral flap by straps provided with buckles which can be adjusted on the straps, just as the abdominal/pectoral flaps are connectable together by straps provided with buckles; the free ends of the straps may be inserted in a number of housings made in the flaps.

7 Claims, 1 Drawing Sheet

HYDROSTATIC BALANCING JACKET FOR UNDERWATER DIVING

BACKGROUND OF THE INVENTION

The present invention relates to a hydrostatic balancing jacket for underwater diving.

Such jacket is, since a long time, considered a fundamental accessory for underwater diving, capable of guaranteeing a positive, negative or hydrostatically neutral thrust to the user, according to his needs.

Normally, the jackets of this type present on the front two shoulder flaps that are fastened to the pectoral/abdominal portion by means of buckles or similar means of connection, whilst one or two buckles enable closing of the said pectoral/abdominal portion.

The buckles, which are usually of the quick-release type, are mounted so that they are adjustable on suitable straps so as to enable them to be adapted to the user of the jacket. In this way, however, the ends of said straps remain free, and hence may easily get caught up in rocks or similar obstacles that the underwater diver may come close to during diving, thus creating situations of effective danger. Furthermore, they may cause trouble to the diver as he is handling his equipment which is by now rather complex (flexible tube for his breathing apparatus, auxiliary tubes, etc.). Finally, the strap ends also cause an increase in friction during swimming.

In addition, the connecting buckles of the shoulder flaps are arranged in positions that are particularly exposed to accidental impact, thus diminishing the safety of the connection itself.

BRIEF SUMMARY OF THE INVENTION

The purpose of the present invention is to provide a balancing jacket in which the straps provided with buckles for closing and reciprocally connecting the flaps of the jacket are not able to get caught up in anything or to hinder the user's movements in any way.

An about of the present invention is thus a hydrostatic balancing jacket for underwater diving, comprising a dorsal element from which there proceed two shoulder flaps and two abdominal/pectoral flaps, each shoulder flap being connectable to the corresponding abdominal/pectoral flap by means of straps provided with buckles, which can be adjusted on the said straps, just as the said abdominal/pectoral flaps are connectable together; characterized in that the free ends of said straps may be inserted in a number of housings made in the said flaps.

In particular, said housings may comprise both a number of openings communicating with as many pockets made in said flaps or applied on the latter, and a number of openings communicating with a single large pocket, made by applying a lappet of material on each of said flaps.

In addition, the buckles of the straps that connect the shoulder flaps to the pectoral/abdominal flaps or the said flaps to one another may be advantageously inserted in appropriate housings, made in said flaps or applied on the latter.

Further advantages and characteristics of the present invention will appear more evident from the following detailed description of an embodiment of the invention, given to provide a non-limiting example, with reference to the single plate of drawings attached.

DETAILED DESCRIPTION OF THE PREFERRED EMBODIMENTS OF THE INVENTION

Figure 1:
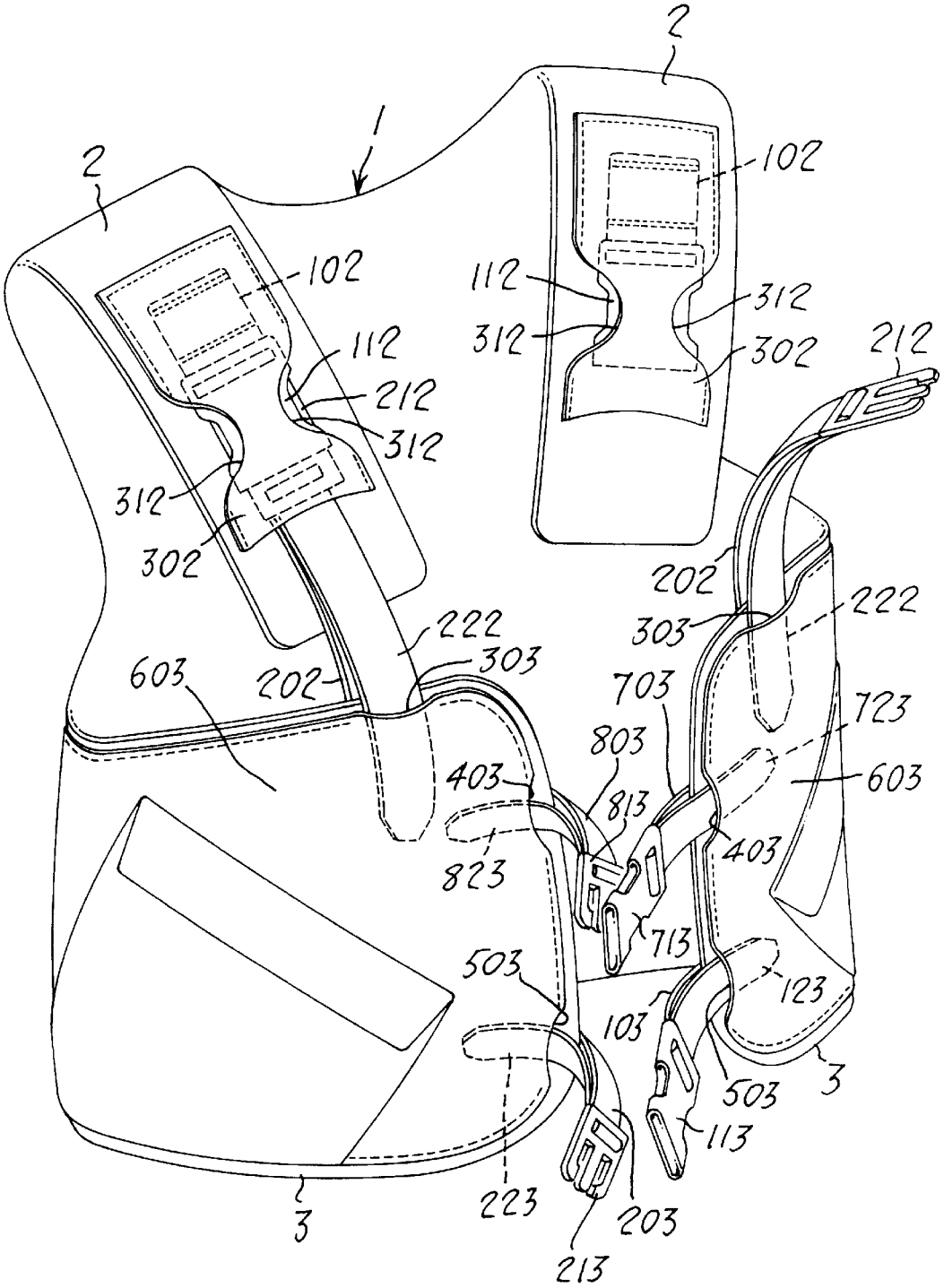
FIG. 1 is a perspective view of the balancing jacket according to the present invention.

FIG. 1 illustrates the balancing jacket according to the present invention. By 1 is designated the dorsal portion of the jacket. From said dorsal portion 1 there proceed, made of a single piece with the said dorsal portion, two shoulder flaps 2 and two pectoral/abdominal flaps 3. To each of said shoulder flaps 2 is connected a strap 102 to which is fastened the female element 112 of a quick-release buckle, the male element 212 of which is fastened to the belt 202, which proceeds from the respective facing pectoral/abdominal flap 3. The strap 102 and the female element 112 of the buckle are housed in the pocket 302 applied on the shoulder flap 2, which is accessible to the male element 212 and provided, on both the major sides, with two openings 312 which enable operations of release of the buckle.

The end 222 of the strap 202 on which the male element 212 of the buckle is fastened is inserted in the opening 303 formed in the lappet 603 of material applied on the flap 3.

In the same way, the straps 103, 203, 703, and 803 which fasten the respective closing mechanisms of the two abdominal/pectoral flaps of the jacket by means of respective female and male quick-release buckle elements 113, 213, 713, and 813 present free ends 123, 223, 723, and 823 that are inserted in the openings 503 and 403 formed in the lappets 603 applied on the flaps 3.

How the jacket according to the present invention works will appear evident from what follows. As has already been described previously, the connection between the shoulder straps 2 and the abdominal/pectoral flaps 3 is by means of straps provided with buckles, in particular quick-release buckles. For each pair of straps to be used for a connection, at least one of the two is adjustable lengthwise. The free end of the adjusted strap, which would thus be in a likely condition to get in the way of the user, is tucked away in a suitable housing, i.e., in an opening formed in the lappet that is applied on the flap to which the strap originating the said end is connected, communicating with the inside of the pocket formed by superposition of the lappet of material on said flap. In this way, the ends of the straps are no longer able to get caught up in any obstacles and can thus no longer cause trouble to the diver during diving. The openings in which the ends are inserted can communicate with a single pocket originated, as illustrated, by the overlapping of the lappets 603 on the flaps 3, or else they can be in communication with a number of pockets, formed directly in the flap or applied on the flap.

In addition, the buckles that enable connection may themselves also be inserted in housings made, in the form of a pocket, like the pocket 302 formed on the shoulder strap 2, in such a way as to make the connection between the flaps of the jacket more secure and better protected. These housings can be made by applying material on said flaps or else by forming the housing inside the flap itself.

What is claimed is:

1. A hydrostatic balancing jacket for a user during underwater diving comprising:

a jacket member including a dorsal element, left and right lateral shoulder flaps attached to left and right top portions of said dorsal element, and left and right abdominal/pectoral flaps attached to left and right lower portions of said dorsal element;

a first connection means for connecting adjacent portions of said abdominal/pectoral flaps to one another, said first connection means including respective left and right first straps attached at attached ends thereof to respective said left and right abdominal/pectoral flaps, and a first buckle having respective left and right first buckle elements which releasably interlock with one another and which are attached to respective said left and right first straps, one of said first buckle elements being adjustably secured along a length of an associated one of said first straps in order to lengthen or shorten a distance between the one said first buckle element and said attached end of the one said first strap and hence to fit said abdominal/pectoral flaps to the user;

a first housing in an associated one of said abdominal/pectoral flaps having said attached end of the one said first strap attached thereto, said first housing receiving therein a free end of the one said first strap in order to prevent the free end of the one said first strap from being caught up;

left and right second connection means for connecting respective adjacent portions of said left and right shoulder flaps with respective adjacent portions of said left and right abdominal/pectoral flaps, each said second connection means including a top second strap attached at attached end thereof to an associated said shoulder flap, a bottom second strap attached at attached end thereof to an associated said abdominal/pectoral flap, and a second buckle having respective top and bottom second buckle elements which releasably interlock with one another and a release member which releases said top and bottom buckle elements from one another, said top and bottom buckle elements being attached to respective said top and bottom second straps, one of said second buckle elements being adjustably secured along a length of an associated one of said second straps in order to lengthen or shorten a distance between the one said second buckle element and said attached end of the one said second strap and hence to fit said shoulder flaps to the user;

left and right second housings for respective said left and right connection means, each said second housing being located in an associated one of said flaps associated with said attached end of the one said second strap attached thereto, each said second housing receiving therein a free end of the one said second strap in order to prevent the free end of the one said second strap from being caught up; and left and right pockets for respective said left and right connection means, each said pocket being located on an associated other one of said flaps to which said attached end of the one said second strap is not attached, having located therein an associated said second buckle in order to secure and protect the associated said second buckle, and including an opening therein through which an associated said release member is accessible by the user.

2. A hydrostatic balancing jacket as claimed in claim 1:

wherein each respective said first housing comprises an opening made in a first lappet applied to the associated said abdominal/pectoral flap; and wherein each respective said second housing comprises an opening made in a second lappet applied to the associated one of said flaps.

3. A hydrostatic balancing jacket as claimed in claim 1:

wherein each respective said first housing comprises an opening made in the associated said abdominal/pectoral flap; and wherein each respective said second housing comprises an opening made in the associated one of said flaps.

4. A hydrostatic balancing jacket as claimed in claim 1:

wherein said first and second buckles are of a quick-release type having male and female said buckle elements.

5. A hydrostatic balancing jacket as claimed in claim 1, wherein each said pocket:

is applied to the associated other one of said flaps, and has attached thereto and housed therein the other said second strap.

6. A hydrostatic balancing jacket as claimed in claim 1:

wherein each said pocket is applied to an associated said shoulder flap; and wherein each said second housing is located in an associated said abdominal/pectoral flap, whereby the free end of the one of said second straps hangs downwards and into the associated said second housing when the user is vertical.

7. A hydrostatic balancing jacket for a user during underwater diving comprising:

a jacket member including a dorsal element, two lateral shoulder flaps attached to top portions of said dorsal element, and two abdominal/pectoral flaps attached to lower portions of said dorsal element;

two first straps attached at attached ends thereof to respective ones of said abdominal/pectoral flaps, a first quick-release buckle having first male and female buckle elements which releasably interlock with one another and which are attached to respective said first straps, one of said first buckle elements being adjustably secured along a length of an associated one of said first straps in order to lengthen or shorten a distance between the one said first buckle element and said attached end of the one said first strap and hence to fit said abdominal/pectoral flaps to the user;

a first housing in an associated one of said abdominal/pectoral flaps having said attached end of the one said first strap attached thereto, said first housing receiving therein a free end of the one said first strap in order to prevent the free end of the one said first strap from being caught up;

two top second straps attached at an attached end thereof to a respective said shoulder flap;

two bottom second straps attached at an attached end thereof to a respective said abdominal/pectoral flap;

two second quick-release buckles, each said buckle having respective top and bottom second buckle elements which releasably interlock with one another via a male-female interconnection and a release member which releases said top and bottom buckle elements from one another, said top and bottom second buckle elements being attached to respective said top and bottom second straps, (a) said bottom second buckle element being adjustably secured along a length of the associated said bottom second strap in order to lengthen or shorten a distance between the said bottom second buckle element and said attached end of said bottom second strap and hence to fit said shoulder flaps to the user, and (b) said top second buckle element being non-adjustably secured to the associated said top second strap;

two second housings for respective said second buckles, each said second housing being located in an associated said abdominal/pectoral flap associated with said attached end of said bottom second strap attached thereto, each said second housing receiving therein a free end of said bottom second strap in order to prevent the free end of said bottom second strap from being caught up; and two pockets for respective said second buckles, each said pocket being located on an associated said shoulder flap to which said attached end of said top second strap is attached, having located therein said top second strap and an associated said second buckle in order to secure and protect the associated said second buckle, and including an opening therein through which an associated said release member is accessible by the user.

* * * * *